US012663190B2

(12) United States Patent
Pitts et al.

(10) Patent No.: US 12,663,190 B2
(45) Date of Patent: Jun. 23, 2026

(54) LIQUID LEVEL CONTROL OF EXPANSION VALVES IN CLIMATE CONTROL SYSTEMS

(71) Applicant: Trane International Inc., Davidson, NC (US)

(72) Inventors: Steven J. Pitts, La Crescent, MN (US); Justin D. Piggush, La Crosse, WI (US); Lucas Duffy, La Crosse, WI (US); Lee L. Sibik, Onalaska, WI (US); Bhavana Depuru Guru, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 123 days.

(21) Appl. No.: 18/437,326

(22) Filed: Feb. 9, 2024

(65) Prior Publication Data

US 2025/0257916 A1 Aug. 14, 2025

(51) Int. Cl.
*F25B 49/02* (2006.01)
*F25B 41/31* (2021.01)

(52) U.S. Cl.
CPC ..... *F25B 49/02* (2013.01); *F25B 41/31* (2021.01); *F25B 2400/13* (2013.01); *F25B 2600/2513* (2013.01); *F25B 2700/04* (2013.01)

(58) Field of Classification Search
CPC ..... F25B 49/02; F25B 41/31; F25B 2400/13; F25B 2600/2513; F25B 2700/04
See application file for complete search history.

(56) References Cited

U.S. PATENT DOCUMENTS 5,323,430 A 6/1994 Termaat et al.
5,752,390 A * 5/1998 Hyde ..... F25B 41/00 62/509
5,778,695 A 7/1998 Ring et al.
6,145,332 A 11/2000 Hyde
6,182,505 B1 2/2001 Segeral
(Continued)

FOREIGN PATENT DOCUMENTS

CN 103727695 A * 4/2014
CN 111174471 A 5/2020
WO 2019/023267 A1 1/2019

OTHER PUBLICATIONS

Jang, Turbo Chiller, Apr. 16, 2014, CN103727695A, Whole Document (Year: 2014).*

(Continued)

*Primary Examiner* — Larry L Furdge
(74) *Attorney, Agent, or Firm* — Womble Bond Dickinson (US) LLP

(57) ABSTRACT

An example method of controlling a component of a climate control system includes discharging a multiphase fluid from a condenser of the climate control system. In addition, the method includes flowing the multiphase fluid though a conduit that is downstream of the condenser, the multiphase fluid including a liquid portion and a gas portion and diverting a portion of the multiphase fluid out of the conduit and into a receptacle. Further, the method includes determining a parameter of the multiphase fluid in the receptacle, the parameter corresponding to a composition of the liquid portion and the gas portion of the multiphase fluid. Still further, the method includes controlling the component of the climate control system based at least in part on the parameter.

17 Claims, 7 Drawing Sheets

(56) References Cited

U.S. PATENT DOCUMENTS

| | | | |
|---|---|---|---|
| 8,051,675 | B1 | 11/2011 | Carlson et al. |
| 9,568,227 | B2 | 2/2017 | Douglas et al. |
| 2015/0114017 | A1 | 4/2015 | Hayashi et al. |

OTHER PUBLICATIONS

Extended European Search Report for Application No. EP2556796, issued on Jun. 11, 2025, 8 pages.

* cited by examiner

LIQUID LEVEL CONTROL OF EXPANSION VALVES IN CLIMATE CONTROL SYSTEMS

CROSS-REFERENCE TO RELATED APPLICATIONS

Not applicable.

BACKGROUND

A climate control system may circulate a refrigerant to condition (e.g., cool and/or heat) the air within a conditioned space. The conditioned space may be the interior of a home, office, retail center, manufacturing space, a storage container, etc.

At an industrial or commercial level, a climate control system may include a chiller which transfers heat between the conditioned space and the outer environment via the refrigerant circuit and one or more additional fluid circuits. For instance, a chiller may utilize a chilled water circuit to transfer heat between the refrigerant and the indoor space, and may utilize an additional fluid to transfer heat between the refrigerant and the outer environment. When the additional fluid circuit includes water (or an aqueous solution), the chiller may be referred to as a "water-cooled" chiller, and when the additional fluid circuit includes air, the chiller may be referred to as an "air-cooled" chiller.

BRIEF SUMMARY

Some embodiments disclosed herein are directed to a method of controlling a component of a climate control system. In some embodiments, the method includes discharging a multiphase fluid from a condenser of the climate control system and flowing the multiphase fluid though a conduit that is downstream of the condenser, the multiphase fluid including a liquid portion and a gas portion. In addition, the method includes diverting a portion of the multiphase fluid out of the conduit and into a receptacle. Further, the method includes determining a parameter of the multiphase fluid in the receptacle, the parameter corresponding to a composition of the liquid portion and the gas portion of the multiphase fluid. Still further, the method includes controlling the component of the climate control system based at least in part on the parameter.

Some embodiments disclosed herein are directed to a climate control system. In some embodiments, the climate control system includes a condenser that is configured to at least partially condense a refrigerant, an actuatable component that is configured to adjust a flow characteristic of the refrigerant, and a conduit in fluid communication with an outlet of the condenser and positioned upstream of the actuatable component such that the conduit is configured to channel the refrigerant discharged out of the condenser toward the actuatable component. In addition, the climate control system includes a receptacle in fluid communication with the conduit such that at least a portion of the refrigerant flowing through the conduit is diverted into the receptacle. Further, the climate control system includes a sensor configured to detect a parameter indicative of a liquid level of the refrigerant in the receptacle. Still further, the climate control system includes a controller communicatively coupled to the sensor and the actuatable component, wherein the controller is configured to actuate the actuatable component based at least in part on an output from the sensor.

Some embodiments disclosed herein are directed to a chiller for conditioning an indoor space. In some embodiments, the chiller includes an evaporator configured to at least partially vaporize a refrigerant, a compressor downstream of the evaporator that is configured to compress the refrigerant, and a condenser downstream of the compressor that configured to at least partially condense the refrigerant. In addition, the chiller includes an economizer in fluid communication between the condenser and the evaporator that is configured to divert gaseous refrigerant to the compressor in bypass of the evaporator, a conduit that connects the condenser to the economizer, and an expansion valve positioned along the conduit. Further, the chiller includes a stand tube in fluid communication with the conduit and positioned upstream of the expansion valve and a sensor configured to detect a parameter indicative of a refrigerant liquid level in the stand tube. Still further, the chiller includes a controller communicatively coupled to the sensor and the expansion valve, wherein the controller and configured to adjust a position of the expansion valve based at least in part on an output from the sensor.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

A climate control system, such as a chiller, may utilize a refrigerant circuit to transfer heat between an outer environment and a conditioned space. Efficient operation of the refrigerant circuit in a chiller (or other climate control system) may include achieving and maintaining a fluid balance of refrigerant throughout the refrigerant circuit. Otherwise, some components may be flooded with excess refrigerant while others may be starved of refrigerant, which may ultimately lead to operational inefficiencies and potential increased risk of components wear or failure.

Thus, one or more actuatable components (e.g., valves) may be positioned along the refrigerant circuit to control the flow of refrigerant during operations. However, control of these actuatable components may be difficult for some climate control systems. For instance, in some cases, an expansion valve in a refrigerant circuit may be controlled based on an amount of liquid refrigerant located in the condenser. However, measurement of a liquid level inside the condenser may require additional refrigerant volume in the refrigerant circuit which is costly-especially for larger capacity chillers. Thus, one may wish to control a valve using a similar liquid volume or level measurement in the piping or conduit of the refrigerant circuit; however, the volatile, two-phase nature of the refrigerant within these conduits may make an accurate measurement or detection of the liquid level extremely difficult or even impossible during operations.

Accordingly, embodiments disclosed herein include systems and methods for detecting an effective level or amount of liquid refrigerant in a conduit of a climate control system for use in controlling an actuatable component (e.g., an expansion valve). For instance, the systems may include a receptacle that is separate from and in fluid communication with the main conduit of the refrigerant circuit. During operations, the receptacle may temporarily hold a volume of the refrigerant flowing along the main conduit so that an accurate determination or measurement of the liquid level therein may be made. The liquid level (or value indicative thereof) may then be used to control the actuatable component to ensure sufficient flow of refrigerant throughout the circuit. Accordingly, through use of the embodiments disclosed herein, an actuatable component of a climate control system (e.g., such as a chiller) may be accurately controlled so as to ensure a balance of refrigerant in the refrigerant circuit and thereby efficient operation of climate control system during operations.

Figure 1:
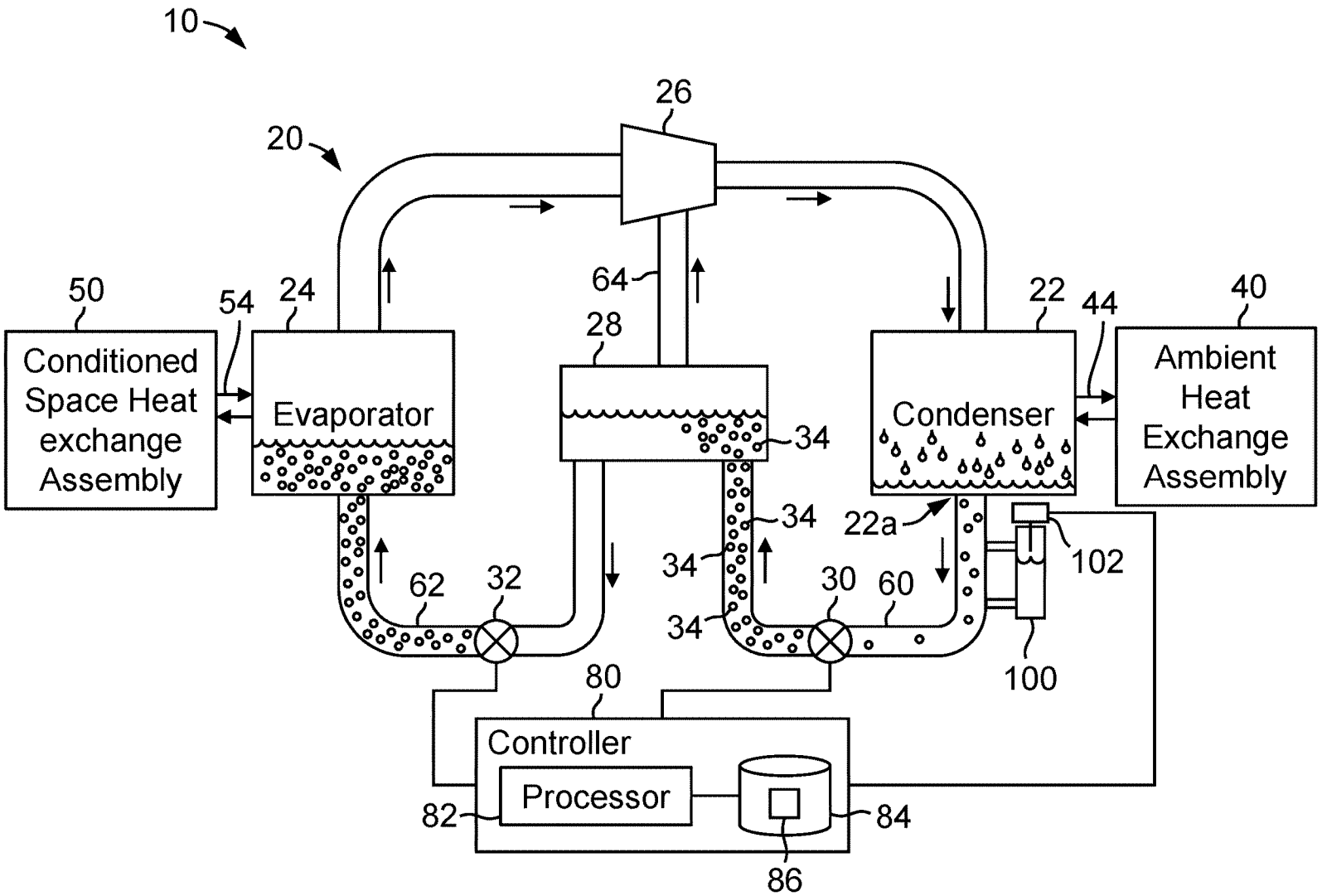
FIG. 1 is a schematic view of a climate control system including a receptacle for detecting a liquid height of refrigerant according to some embodiments disclosed herein.

Referring now to FIG. 1, a climate control system 10 according to some embodiments disclosed herein is shown. As shown in FIG. 1, the climate control system 10 comprises a chiller unit that is configured to cool or heat a conditioned space (e.g., such as the interior of an office building, retail store, convention center, an industrial process, etc.). Thus, the climate control system 10 may be referred to herein as a "chiller unit."

Generally speaking, the chiller unit 10 includes a refrigerant circuit 20 that is configured to circulate a refrigerant to exchange heat between the conditioned space and an ambient environment (e.g., such as the outdoor environment that surrounds the conditioned space), so as to cool or heat the conditioned space. The refrigerant may include a condenser 22 and an evaporator 24. The condenser 22 and evaporator 24 are both heat exchangers (e.g., shell and tube heat exchangers, plate heat exchangers, fin-tube heat exchangers, etc.) that are configured to transfer heat between the refrigerant circulating within the refrigerant circuit 20 and one or more other fluids or environments. Specifically, the condenser 22 is configured to exchange heat between the refrigerant and a working fluid 44 of an ambient heat exchange assembly 40, and the evaporator 24 is configured to exchange heat between the refrigerant and a working fluid 54 of a conditioned space heat exchange assembly 50.

In some embodiments, the working fluid 54 of the conditioned space heat exchange assembly 50 may comprise water (or a suitable aqueous mixture). The working fluid 54 may circulate between the evaporator 24 of the refrigerant circuit 20 and the conditioned space heat exchange assembly 50 to exchange heat between the refrigerant and the conditioned space during operations. In some embodiments, the conditioned space heat exchange assembly 50 may comprise one or more heat exchangers (e.g., air handler units) that are configured to exchange heat between the working fluid 54 and the conditioned space. In some embodiments, the working fluid 54 may comprise a fluid other than water, such as, for instance air (e.g., air that is directly provided to the conditioned space).

The working fluid 44 of the ambient heat exchange assembly 40 may comprise water or any other suitable aqueous mixture such as previously described above for the working fluid 54. Alternatively, the working fluid 44 may comprise air. When the working fluid 44 is water, the chiller unit 10 may be referred to as a "water-cooled" chiller unit, and when the working fluid is air, the chiller unit 10 may be referred to as an "air-cooled" chiller unit. Regardless, the working fluid 44 may circulate between the condenser 22 of the refrigerant circuit 20 and the ambient heat exchange assembly 40 to exchange heat between the refrigerant and the ambient environment. In some embodiments, the ambient heat exchange assembly 40 comprises one or more heat exchangers (e.g., water cooling towers, radiators, fin-fan coolers, etc.) that are configured to transfer heat between the ambient environment and the working fluid 44. In some embodiments, such as in the case of air-cooled chiller units, the ambient heat exchange assembly 40 may be integrated and combined with the condenser 22 so that heat is directly exchanged between the refrigerant and an airflow that is sourced from and provided back to the ambient environment.

In addition to the condenser 22 and the evaporator 24, the refrigerant circuit 20 may include a compressor 26, an economizer 28, and a plurality of actuatable expansion valves 30, 32. The compressor 26 may be in fluid communication between the evaporator 24 and condenser 22 (specifically, downstream of the evaporator 24 and upstream of the condenser 22) so that during operations, the compressor 26 may receive a flow of refrigerant from the evaporator 24 and may discharge a compressed refrigerant to the condenser 22 during operations.

Likewise, the economizer 28 may also be in fluid communication between the condenser and evaporator, opposite the compressor 26. Specifically, the economizer 28 may be downstream of the condenser 22 and generally upstream of the evaporator 24. During operations, the condenser 22 may discharge refrigerant to the economizer 28, and the economizer 28 may in turn discharge refrigerant to the evaporator 24.

The expansion valves 30, 32 may comprise actuatable components of the refrigerant circuit 20 that may be used to control one or more flow parameters of the refrigerant circulating through the refrigerant circuit 20 during operations. For instance, the expansion valves 30, 32 may be opened or closed to affect one or more of a pressure, temperature, or flow rate of the refrigerant along one or more points or portions of the refrigerant circuit 20. Specifically, the expansion valves 30, 32 include a first expansion valve 30 that is positioned along a first conduit 60 connecting an outlet 22*a* of the condenser 22 to the economizer 28, and a second expansion valve 32 that is positioned along a second conduit 62 connecting the economizer 28 to the evaporator 24. The expansion valves 30, 32 may be actuated-such as electrically actuated, pneumatically actuated, hydraulically actuated, etc. so as to allow for active control of the refrigerant flow through the conduits 60, 62 and throughout the refrigerant circuit 20 during operations. In some embodiments, one or more of the expansion valves 30, 32 may be replaced with a static flow expansion device, such as an orifice plate or other suitable component.

During operations, the refrigeration circuit 20 may be operated to circulate the refrigerant as shown in FIG. 1 to transfer heat from the conditioned space (e.g., via the conditioned space heat exchange assembly 50) to the ambient environment (e.g., via the ambient heat exchange assembly 40). Specifically, the refrigerant (which may be in a vapor or semi-vapor state) may be compressed by the compressor 26 and delivered to the condenser 22. Within the condenser 22, heat is transferred from the refrigerant to the working fluid 44, which cools the refrigerant and at least partially condenses the refrigerant to a liquid. Heat is then transferred from the heated working fluid 44 to the ambient environment via the ambient heat exchange assembly 42 of the ambient heat exchange assembly 40 as previously described.

The at least partially condensed refrigerant is then expelled from the condenser 22 and flowed to the economizer 28 via the first expansion valve 30. The first expansion valve 30 may be actuated so as to controllably expand the refrigerant within the conduit 60. This expansion may cause the refrigerant to at least partially vaporize to form a plurality of gas bubbles 34. Without being limited to this or any other theory, remaining heat carried in the refrigerant downstream of the condenser 22 may be concentrated (at least partially) in the plurality of gas bubbles 34, so that a temperature of the liquid component of the refrigerant, downstream of the first expansion valve 30 may be reduced.

The at least partially expanded refrigerant may then be flowed into the economizer 28 via the conduit 60, downstream of the first expansion valve 30. The economizer 28 may function as a vapor-liquid separator that allows the gas bubbles 34 in the refrigerant to separate from the liquid remainder. The separated gas bubbles 34 may flow back to the compressor 26 via a gas vent line 64, so that the separated, vaporized refrigerant may be re-compressed and further cooled via the condenser 22 as previously described. Accordingly, the vaporized refrigerant exiting the economizer 28 may bypass the evaporator 24 and flow back to the compressor 26 directly via the gas vent line 64. As a result, rerouting the separated vapor portion of the refrigerant to the compressor 26 and condenser 22 may allow this additional heat to be transferred (or at least partially transferred) to the ambient environment via the ambient heat exchange assembly 40 and working fluid 44 as previously described, which may improve the efficiency of the refrigerant circuit 20 overall.

Liquid (or substantially liquid) refrigerant may then flow out of the economizer 28 to the second expansion valve 32 via the second conduit 62. The second expansion valve 32 may again expand the refrigerant so as to partially vaporize and cool the refrigerant. The expanded and cooled refrigerant is then flowed to the evaporator 24. Within the evaporator 24, heat is transferred from the working fluid 54 to the refrigerant, which continues to boil (or vaporize) the refrigerant. The cooled working fluid 54 is then used to cool the conditioned space via the conditioned space heat exchange assembly 52 of the conditioned space heat exchange assembly 50 as previously described. The vaporized (or substantially vaporized) refrigerant may then be returned to the compressor 26 to restart the process described above.

Referring still to FIG. 1, during operation with the chiller unit 10, the expansion valves 30, 32 may be actuated not only to controllably expand and vaporize the refrigerant to support and facilitate the transfer of heat within the condenser 22 and evaporator 24, but also to control the distribution of refrigerant through the refrigerant circuit 20. Specifically, the first expansion valve 30 may be actuated (e.g., closed, opened, or partially opened) to adjust a flow rate of refrigerant out of the condenser 22 and ultimately into the evaporator 24. An improper positioning of the first expansion valve 30 (relative to a flow rate of refrigerant through the compressor 26) may cause a fluid imbalance in the refrigerant circuit 20 which thereby causes either excessive vapor refrigerant flow past the expansion valve 30 or inadequate liquid refrigerant supply to the evaporator 24. Both of these outcomes ultimately result an increased load on the compressor 26 and reduced operating efficiency for the climate control system 10).

The climate control system 10 may be configured to operate at full capacity while maintaining a suitable fluid balance through the refrigerant circuit 20. However, changing conditions, such as changing temperature in the ambient environment, may lead to or cause a change in the operating speed of the compressor 26, which may in turn alter the flow rate of refrigerant flowing into the condenser 22.

Thus, the expansion valve 30 may be controlled to maintain a desired or target flow rate of refrigerant therethrough to help ensure substantial balance of refrigerant flow throughout the refrigerant circuit 20. Specifically, the expansion valve 30 may be controlled to match a flow rate of refrigerant out of the condenser 22 to a discharge flow rate from the compressor 26 to substantially equalize flow across the condenser 22 and refrigerant circuit 20 more broadly. Alternatively, the expansion valve 30 may be controlled (e.g., closed, opened, or partially opened) based on a liquid level of the refrigerant inside of the condenser 22. However, maintaining a consistent and measurable liquid level of refrigerant inside of the condenser 22 may require additional cooling capacity in the condenser 22 (e.g., via a sub cooler or other suitable device or system) and larger charge of refrigerant—both of which would increase the cost and complexity of the chiller unit 10. As a result, an alternative strategy is to avoid collecting substantial liquid refrigerant in the condenser 22 and to instead measure or detect a liquid level of refrigerant in the first conduit 60, upstream of the first expansion valve 30. However, the flow of refrigerant emitted from the condenser 22 into the first conduit 60 is two-phase and is highly turbulent and dynamic. As a result, useful and accurate direct measurement of a liquid level in the conduit 60, upstream of the first expansion valve 30 is difficult.

Accordingly, the chiller unit 10 includes a separate receptacle 100 that is in fluid communication with the conduit 60 and that receives and temporarily holds a volume of refrigerant flowing through the conduit 60 during operations. As will be described in more detail below, the receptacle 100 may temporarily hold a volume of liquid refrigerant therein under less dynamic conditions than are present in the conduit 60 so that a sensor 102 coupled to the receptacle 100 may be used to measure or detect the liquid level (or one or more values or parameters indicative thereof) within the receptacle 100 during operations. The liquid level within the receptacle 100 may be utilized as a representative substitute for the liquid level in the conduit 60, which may then be used (at least partially) to control an opening position of the expansion valve 30 for providing a fluid balance within the refrigerant circuit 20.

A controller 80 may be communicatively coupled (via any suitable wired and/or wireless connection) to the sensor 102 and the expansion valve 30 (or a motor, driver, or individual controller thereof). The controller 80 may be configured to receive the output from the sensor 102 and the actuate the expansion valve 30 to a desired position based at least partially on the sensor output to achieve or maintain a desired liquid level upstream of the valve 30 (and therefore a refrigerant fluid balance throughout the refrigerant circuit 20).

The controller 80 may be (or may be incorporated within) a main or master controller for the chiller unit 10, or the controller 80 may be a standalone controller 80 for controlling the opening position of the first expansion valve 30. Regardless, the controller 80 may be described and referred to herein as being a part of the chiller unit 10.

The controller 80 may comprise one or more computing devices, such as a computer, tablet, smartphone, server, circuit board, or other computing device(s) or system(s). Thus, controller 80 may include a processor 82 and a memory 84.

The processor 82 may include any suitable processing device or a collection of processing devices. In some embodiments, the processor 82 may include a microcontroller, central processing unit (CPU), graphics processing unit (GPU), timing controller (TCON), scaler unit, or some combination thereof. During operations, the processor 82 executes machine-readable instructions (such as machine-readable instructions 86) stored on memory 84, thereby causing the processor 82 to perform some or all of the actions attributed herein to the controller 80. In general, processor 82 fetches, decodes, and executes instructions (e.g., machine-readable instructions 86). In addition, processor 82 may also perform other actions, such as, making determinations, detecting conditions or values, etc., and communicating signals. If processor 82 assists another component in performing a function, then processor 82 may be said to cause the component to perform the function.

The memory 84 may be any suitable device or collection of devices for storing digital information including data and machine-readable instructions (such as machine-readable instructions 86). For instance, the memory 84 may include volatile storage (such as random-access memory (RAM)), non-volatile storage (e.g., flash storage, read-only memory (ROM), etc.), or combinations of both volatile and non-volatile storage. Data read or written by the processor 82 when executing machine-readable instructions 86 can also be stored on memory 84. Memory 84 may include "non-transitory machine-readable medium," where the term "non-transitory" does not include or encompass transitory propagating signals.

The processor 82 may include one processing device or a plurality of processing devices that are distributed within (or communicatively coupled to) controller 80 or more broadly within chiller unit 10. Likewise, the memory 84 may include one memory device or a plurality of memory devices that are distributed within (or communicatively coupled to) controller 80 or more broadly within chiller unit 10. Thus, the controller 80 may comprise a plurality of individual "controllers" distributed throughout the chiller unit 10.

Figure 2:
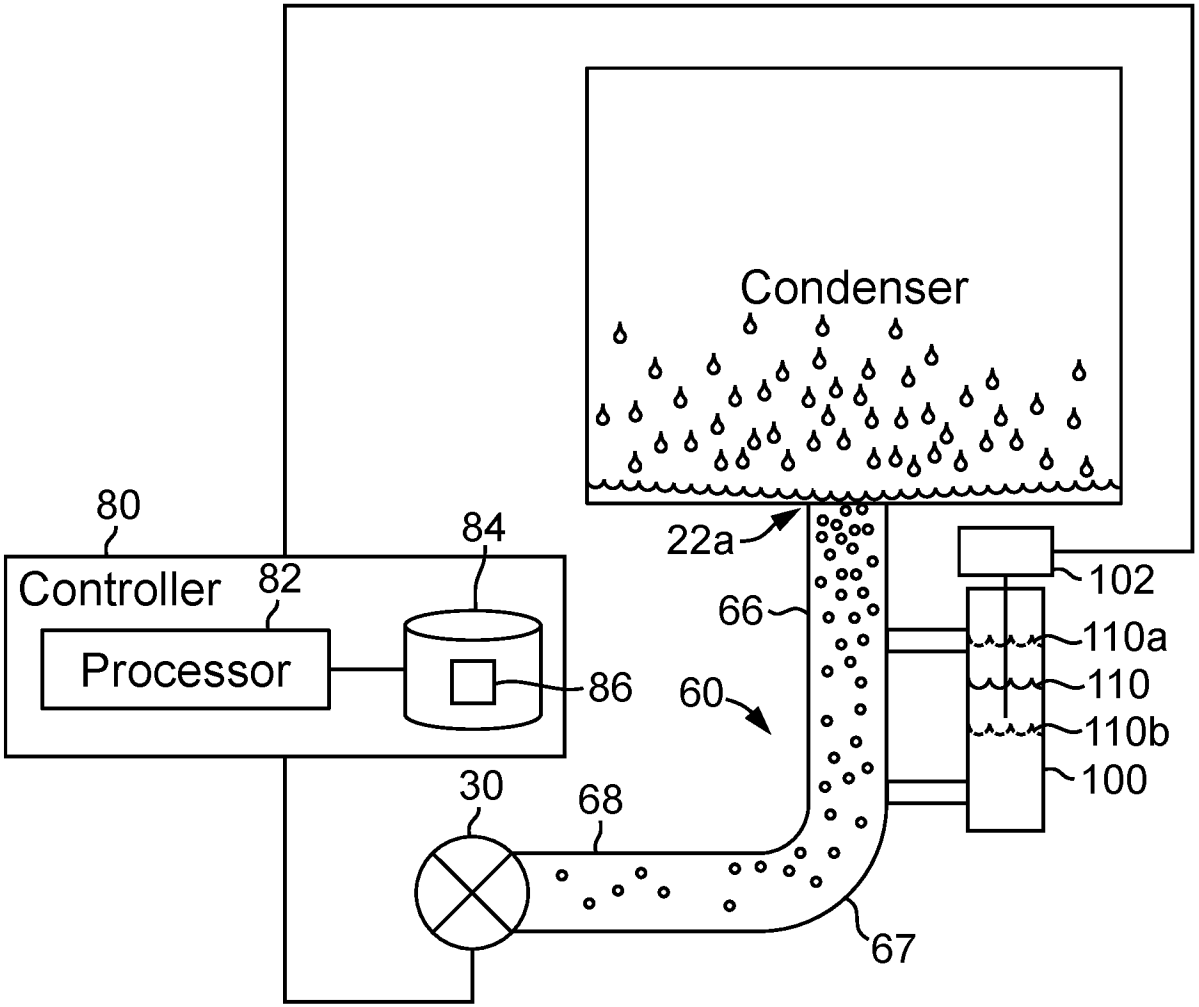
FIG. 2 is an enlarged, schematic view of a portion of the climate control system of FIG. 1 according to some embodiments disclosed herein.

Referring now to FIG. 2, a portion of the chiller unit 10 is shown, so as to better illustrate the first conduit 60, receptacle 100, and function thereof according to some embodiments. The conduit 60 (or at least the portion of the conduit 60 extending from the condenser to the expansion valve 30) may include a first portion 66 that is connected to the condenser 22 and a second portion 68 that is connected to the expansion valve 30. The first portion 66 may be oriented substantially vertically (or generally along the direction of gravity), and the second portion 68 may be oriented substantially horizontally or laterally (or generally perpendicular to the direction of gravity). An elbow (e.g., a 90° elbow) 67 connects the first portion 66 to the second portion 68 so as to transition the flow of refrigerant from a substantially vertical direction (within the first portion 66) to a substantially horizontal direction (within the second portion 68).

The receptacle 100 may comprise a stand tube that is connected to and in fluid communication with the first portion 66 of the conduit 60 (thus, the receptacle 100 may be referred to herein as "stand tube 100"). The stand tube 100 may be oriented substantially parallel with the first portion 66 of the conduit 60 so that the stand tube 100 may, itself also be oriented substantially vertically. The stand tube 100 may include a pair of ports 104, 106 that are spaced from one another, with a first port 104 of the pair of ports 104, 106 being positioned vertically higher than a second port 106 of the pair of ports 104, 106. The ports 104, 106 may be in fluid communication with the conduit 60 via corresponding flow tubes or pipes 108. During operations, the refrigerant flowing within the conduit 60 may generally flow into and out of the stand tube 100 via the ports 104, 106 and pipes 108. Generally speaking, the condensed and condensing refrigerant may coalesce into a liquid as it flows toward the expansion valve 30. As a result, primarily liquid refrigerant may flow into the stand tube 100 via the vertically lower, second port 106 to establish a liquid level or height 110 within the stand tube 100 that is generally related or correlated to the liquid height in the conduit 60 itself. The refrigerant may then flow back into the first portion 66 of conduit 60 via the first port 104.

The sensor 102 may be configured to measure or detect the liquid height 110 or a value or parameter indicative of the liquid height 110 during operations. For example, the sensor 102 may comprise a float sensor, an optical sensor (or sensor array), energy wave (e.g., ultrasonic) sensor, etc. that is configured to directly detect or measure a liquid height 110 (or liquid-vapor interface) in the stand tube 100 during operations. In some embodiments, the sensor 102 may comprise a capacitance sensor that includes a probe inserted within the stand tube 100 to contact the liquid refrigerant contained therein. As the liquid height 110 rises or falls within the stand tube 100, the contact surface area between the liquid refrigerant and the probe changes, which in turn changes an electrical capacitance of the probe during operations. The output signal may include a capacitance reading of the probe which then may be converted (e.g., by the controller 80) into the liquid height 110 value.

Alternatively, in some embodiments, the sensor 102 may be configured to measure or detect other parameters that may correspond or be related to the liquid height 110 in the stand tube 100. For instance, the sensor 102 may be configured to measure a mass of the refrigerant within the stand tube 100. In some specific examples, the sensor 102 may comprise or include a load sensor that is configured to measure a mass of the stand tube 100 and refrigerant contained therein, and the controller 80 may calculate a liquid volume and thereby a liquid height 110 within the stand tube 100 based at least partially on the measured mass (and the known densities of the liquid and vapor portions the two-phase refrigerant flow).

In some embodiments, additional valve (not shown) may be utilized to quickly isolate the refrigerant contained in the stand tube 100. Thereafter, the refrigerant trapped within the stand tube 100 may be drained to or through a separate measurement device (e.g., flow meter) that is configured to measure a liquid flow rate out of the stand tube 100. The measured flow rate (e.g., mass flow rate) may then be used (e.g., by the controller 80) to determine the liquid volume (and therefore liquid height 110) that was previously captured within the stand tube 100.

Regardless of the method or technique utilized to measure the liquid height 110 (or indicative value/parameter), the controller 80 may actuate the expansion valve 30 to a position that is configured to adjust or maintain the liquid height 110 at a desired level for efficient operation of the refrigerant circuit 20 (FIG. 1). For instance, the liquid height 110 may be controlled to a target value by the controller 80 so that if the liquid height 110 rises sufficiently above the target liquid height 110 (e.g., to an increased liquid height 110*a* shown in FIG. 2), the controller 80 may, in response, actuate the expansion valve 30 to open (or increase a flow rate therethrough) and thereby reduce the liquid height 110 back to the target value. If, on the other hand, the liquid height 110 decreases sufficiently below the target liquid height 110 (e.g., to a decreased liquid height 110*b* shown in FIG. 2), the controller 80 may, in response, actuate the expansion valve 30 to close (or reduce a flow rate therethrough) and thereby increase the liquid height 110 back to the target value.

The controller 80 may utilize any suitable control mechanism, algorithm, or technique for maintaining the target liquid level 110 in the stand tube 100. For instance, in some embodiments, the controller 80 may utilize a PID (proportional, integrating, and derivative) feedback control loop that is configured to reduce an error between the measured/detected liquid height 110 and the target value to zero (or a suitable range about zero). However, other control schemes are contemplated.

Referring again to FIG. 1, in some embodiments, the controller 80 may also adjust a position of the second expansion valve 32 based at least in part on the liquid height 110 in the stand tube 100. For instance, the controller 80 may adjust a position of the second expansion valve 32 as a function of the position of the first expansion valve 30, which (as previously described) may be a function of the liquid height 110 in stand tube 100. In some embodiments, the controller 80 may determine a mass flow rate of refrigerant through the first expansion valve 30 based on an adjusted positioned thereof, and then may adjust the position of the second expansion valve 32 so as to ensure a sufficient or desired mass flow rate of refrigerant into the evaporator 24 based at least in part on the mass flow rate determined based on the position of the first expansion valve 30.

Figure 3:
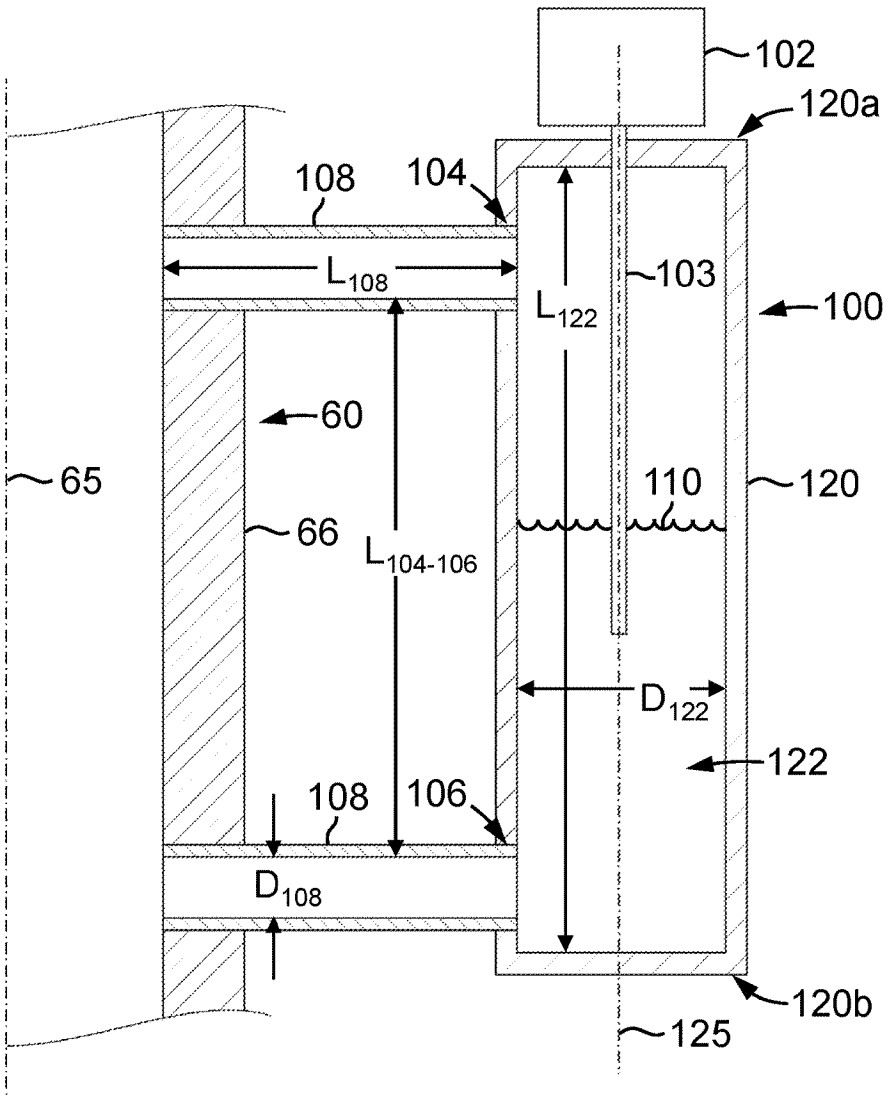
FIG. 3 is an enlarged cross-sectional view of a portion of a conduit and the receptacle of the climate control system of FIG. 1 according to some embodiments.

Referring now to FIG. 3, an enlarged cross-sectional view of the first portion 66 of conduit 60 and the stand tube 100 is shown according to some embodiments. The stand tube 100 may (according to some embodiments) comprise a cylindrical body 120 having a central or longitudinal axis 125 (or more simply "axis 125"), a first or upper end 120*a*, and a second or lower end 120*b* spaced from the upper end 120*a* along the axis 125.

As previously described, the stand tube 100 may be generally oriented parallel to the first portion 66 of the conduit 60. Specifically, as shown in FIG. 3, the axis 125 of the body 120 may be generally parallel to a central axis 65 of the conduit 60 within the first portion 66. As a result, the axis 125 of the body 120 may be oriented substantially vertically (or substantially along the direction of gravity). In addition, as is also previously described, the first port 104 may be positioned vertically higher than the second port 106. As a result, the first port 104 may be more proximate the upper end 120*a* than the lower end 120*b*, and the second port 106 may be more proximate the lower end 120*b* than the upper end 120*a*. Thus, the first port 104, and second port 106 may be axially spaced from one another along the axis 125.

The body 120 defines a generally cylindrically shaped chamber 122 therein. The chamber 122 may include a length $L_{122}$ that extends axially along the axis 125 and a diameter $D_{122}$ that extends radially (relative to axis 125) between the inner walls within body 120 defining chamber 122. Thus, the diameter $D_{122}$ may be an inner diameter of the cylindrical body 120. The length $L_{122}$ and diameter $D_{122}$ may define a volume within the chamber 122 that may receive refrigerant during operations. The volume and/or one or both of the length $L_{122}$ and diameter $D_{122}$ may be selected to allow the liquid height 110 in the stand tube 100 to remain sufficiently stable in order to allow for the measurement thereof, while preventing the liquid level 110 in stand tube 100 from lagging too far behind actual conditions in the conduit 60.

In some embodiments, the diameter $D_{122}$ of the chamber 122 in stand tube 100 may range from about 0.25 to about 2.5 times the inner diameter of the first portion 66 of the conduit 60.

The first port 104 and the second port 106 may be axially spaced from one another relative to the axis 125 by a distance $L_{104\text{-}106}$. In some embodiments, the length $L_{104\text{-}106}$ may range from about one (1) to about four (4) times an inner diameter of the first portion 66 of the conduit 60. In some specific embodiments, the distance $L_{104\text{-}106}$ may be at least 15 or at least about 20 inches in some embodiments in order to allow a measurable liquid level 110 to form in the chamber 122 during operations.

The first port 104 and the second port 106 may be in fluid communication with the first portion 66 of conduit 60 via pipes 108 as previously described. Each of the pipes 108 may have a diameter $D_{108}$ (e.g., an inner diameter) and a length $L_{108}$ that generally extends perpendicularly to the axis 125 (and also the axis 65 within the first portion 66 of conduit 60). In some embodiments, the length $L_{108}$ and diameter $D_{108}$ may be selected so as to reduce a pressure drop in the refrigerant as it flows along the conduit 60 and/or through the pipes 108 during operations. In some embodiments, the diameter $D_{108}$ may range from about 0.025 to about 0.25 times the inner diameter of the first portion 66 of the conduit 60. In some embodiments, the diameter may range from about 0.5 inches to about 0.75 inches, and the length $L_{108}$ may be about 20 inches or less; however, other values are contemplated.

In addition, the pipes 108 may remain open so as to maintain fluid communication between the first portion 66 of conduit 60 and chamber 122 of stand tube 100. As a result, the pipes 108 may be substantially free of flow restrictions or obstructions in some embodiments. For instance, pipes 108 may be free from valves or other flow control devices in some embodiments.

In some embodiments, the sensor 102 may include a probe 103 that extends through the upper end 120*a* and into the chamber 122. The probe 103 may be a component of the sensor 102 that directly interacts or engages with the refrigerant in stand tube 100. For instance, the probe 103 may comprise the probe of a capacitance sensor for measuring the liquid height 110 in the stand tube 100 as previously described. In some embodiments, sensor 102 may not include a probe 103 or the probe 103 may be differently shaped, arranged, positioned, sized, etc. Regardless of the size or type of sensor 102 (and/or probe 103), the sensor 102 may be configured such that the detection/measurement range covers the range of expected liquid heights 110 within the stand tube 100 during operations.

Figure 4:
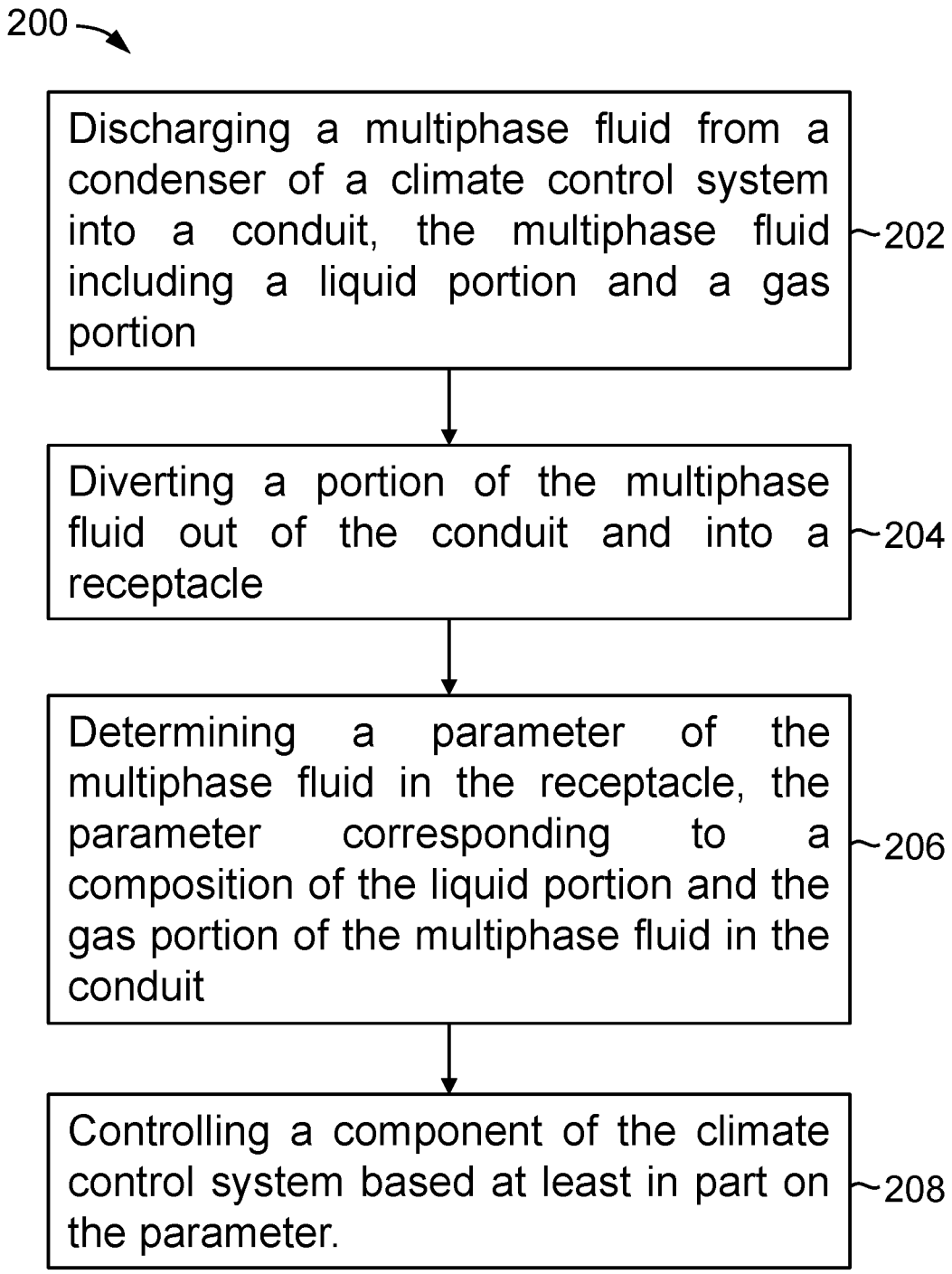
FIG. 4 is a block diagram of a method for controlling a component of a climate control system is shown according to some embodiments disclosed herein.

Referring now to FIG. 4, a method 200 for controlling a component of a climate control system is shown according to some embodiments. In some embodiments, the method 200 may be performed to control an actuatable component, such as one or more of the expansion valves 30, 32 previously described for climate control system 10 (FIG. 1). In addition, in some embodiments, at least some steps of method 200 may be performed (at least partially) by a controller (e.g., controller 80) or other computing device. Thus, in describing the features of method 200, continuing reference is made to the climate control system 10 (and components thereof) shown in FIGS. 1-3 and described herein; however, such continuing reference should not be interpreted as limiting all potential embodiments of method 200.

Initially, method 200 includes discharging a multiphase fluid from a condenser of a climate control system into a conduit at block 202. The multiple fluid includes a liquid portion and a gas portion, and may comprise a refrigerant (e.g., one or more chlorofluorocarbons, hydrochlorofluorocarbons, hydrocarbons, ammonia, etc.). For instance, as shown in FIGS. 1 and 2 and described herein, refrigerant may be at least partially condensed in the condenser 22 and flowed out of the condenser 22 into a conduit 60. The refrigerant flow in the conduit 60 may be two-phase (including both liquid and gas refrigerant therein), and may be highly turbulent and dynamic in nature. As previously described, in some embodiments, the conduit that receives the two-phase fluid may be downstream of the condenser and other components of the climate control system. For instance, in some embodiments, the conduit may extend downstream of an economizer of the climate control system.

In addition, method 200 includes diverting a portion of the multiphase fluid out of the conduit and into a receptacle at block 204. For instance, as described herein for the climate control system 10 (FIG. 1), a portion of the two-phase fluid exiting the condenser 22 into the conduit 60 is diverted into the stand tube 100 via one or both of the port 104, 106 so that liquid refrigerant may collect therein.

Further, method 200 includes determining a parameter of the multiphase fluid in the receptacle at block 206. The parameter may be indicative of a composition of the liquid portion and the gas portion of the multiphase fluid in the conduit. For instance, the parameter may comprise a liquid level, height, depth, etc. of the refrigerant in the receptacle. As previously described, the liquid level in the receptacle may correspond or relate to an effective liquid level of the refrigerant in the conduit 60 and a relative composition of the liquid portion and gas portion of refrigerant in the conduit 60. For instance, the liquid level in the stand tube 100 may correspond to a general relative composition of the liquid and gas portions of the refrigerant in the conduit 60 and may be representative or at least corresponds to an effective liquid level of refrigerant in the conduit 60 during operations. The liquid level may be measured or determined in any suitable manner at block 206. For instance, the liquid level or height may be measured directly via a suitable sensor or sensors (e.g., capacitance sensors, float sensors, level height sensor array, etc.). In addition, the liquid level or height may be measured indirectly via a suitable sensor or sensors (e.g., mass sensor, liquid flow rate sensor, etc.).

Still further, method 200 includes controlling a component of the climate control system based at least in part on the parameter in block 208. For instance, the component may comprise an expansion valve of the climate control system, and controlling the expansion valve may comprise adjusting a position (e.g., opening or closing) the expansion valve to adjust a flow rate of refrigerant therethrough. In addition, as previously described, the parameter may comprise a liquid height of the refrigerant in the receptacle (e.g., stand tube 100). Thus, block 208 may generally include opening or closing an expansion valve based at least in part on a liquid level or height in the receptacle. For instance, in some embodiments, if a liquid height increases (e.g., increases above a target value or range), then block 208 may comprise opening (or increasing an opening amount or percentage) of the expansion valve to increase a flow rate of refrigerant therethrough and thereby reduce the liquid level or height back toward to the target value or range. Conversely, in some embodiments, if a liquid height decreases (e.g., decreases below a target value or range), then block 208 may comprise closing (or decreasing an opening amount or percentage) of the expansion valve to decrease a flow rate of refrigerant therethrough and thereby increase the liquid level or height back toward to the target value or range.

While the climate control system 10 shown in FIG. 1 illustrates the stand tube 100 connected to the conduit 60 extending between the condenser 22 and the first expansion valve 30, it should be appreciated that the stand tube 100 may be positioned in other positions of the climate control system 10 according to other embodiments. For instance, referring now to FIG. 5, in some embodiments, the stand tube 100 may be connected to the second conduit 62 downstream of the economizer 28 and upstream of the evaporator 24.

Specifically, the stand tube 100 may be connected and oriented parallel to a vertical portion of the second conduit 62 that extends downward between the economizer and second expansion valve 32. During operations, the liquid level in the stand tube 100 shown in FIG. 5, may be used to control a position of the first valve 30 and/or the second valve 32 so as to help achieve a substantial balance of refrigerant throughout the refrigerant circuit 20. For instance, in some embodiments, the controller 80 may actuate the first expansion valve 30 to close and/or actuate the second expansion valve 32 to open when a liquid level in the stand tube 100 shown in FIG. 5 (connected to the second conduit 62) is above a target value. Conversely, in some embodiments, the controller 80 may actuate the first expansion valve 30 to open and/or actuate the second expansion valve to close when a liquid level in the stand tube 100 shown in FIG. 5 (connected to the second conduit 62) is below a target value.

Figure 6:
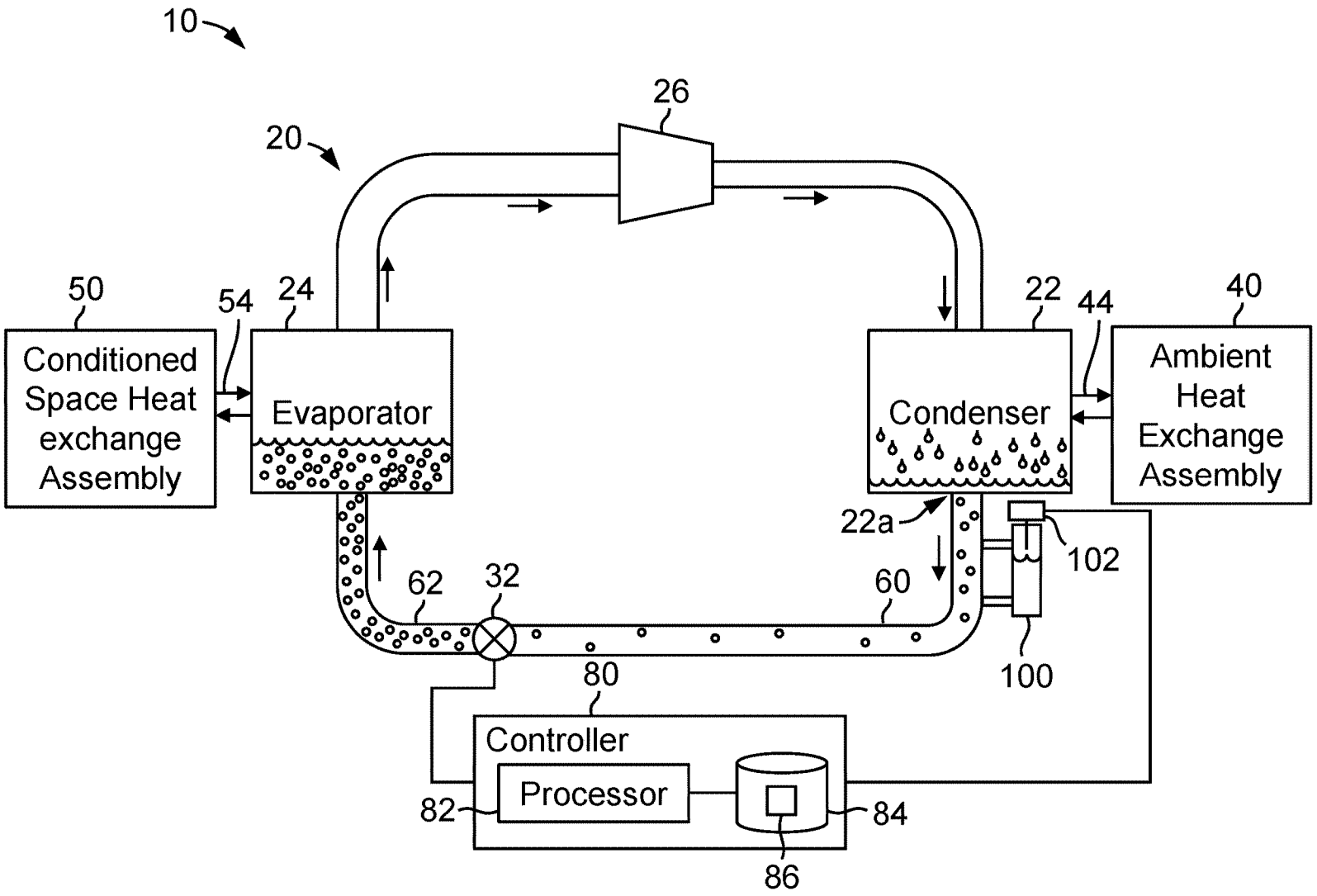
FIG. 6 is a schematic view of a climate control system including a receptacle for detecting a liquid height of refrigerant according to some embodiments disclosed herein.

Referring now to FIG. 6, in some embodiments, the economizer 28 and first expansion valve 30 may be omitted from the refrigerant circuit 20 so that the first conduit 60 may extend from the condenser 22 to the second expansion valve 32. The controller 80 may adjust a position of the second expansion valve 32 based at least in part on the liquid level 110 in the stand tube 100 as previously described for the first expansion valve 30, and thereby help ensure a mass balance of refrigerant throughout the refrigerant circuit 20 during operations. For instance, the controller 80 may actuate the second expansion valve 32 to open when a liquid level in the stand tube 100 increases above a target value, and may actuate the second expansion valve 32 to close when a liquid level in the stand tube 100 decreases below a target value.

Figure 5:
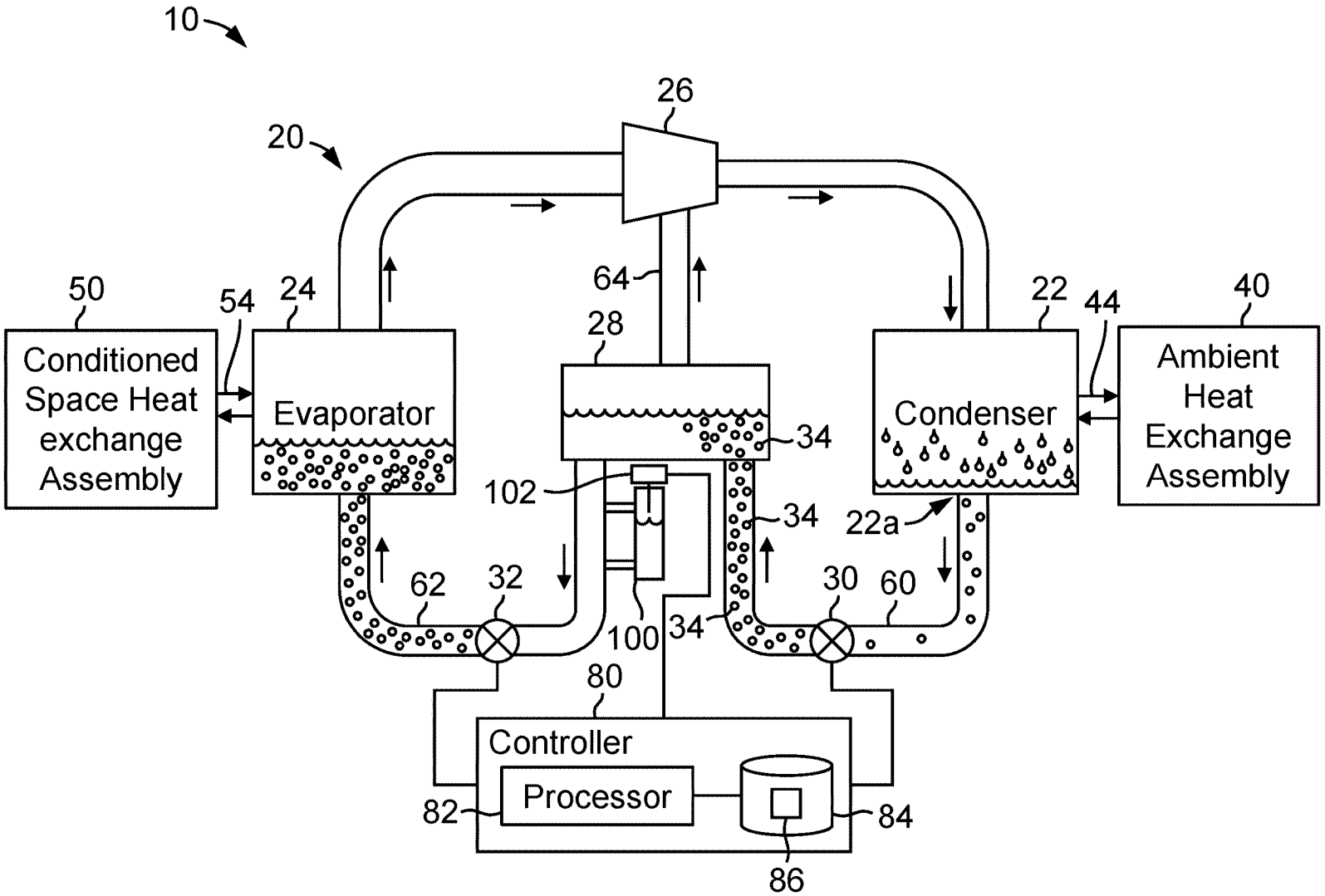
FIG. 5 is a schematic view of a climate control system including a receptacle for detecting a liquid height of refrigerant according to some embodiments disclosed herein.
Figure 7:
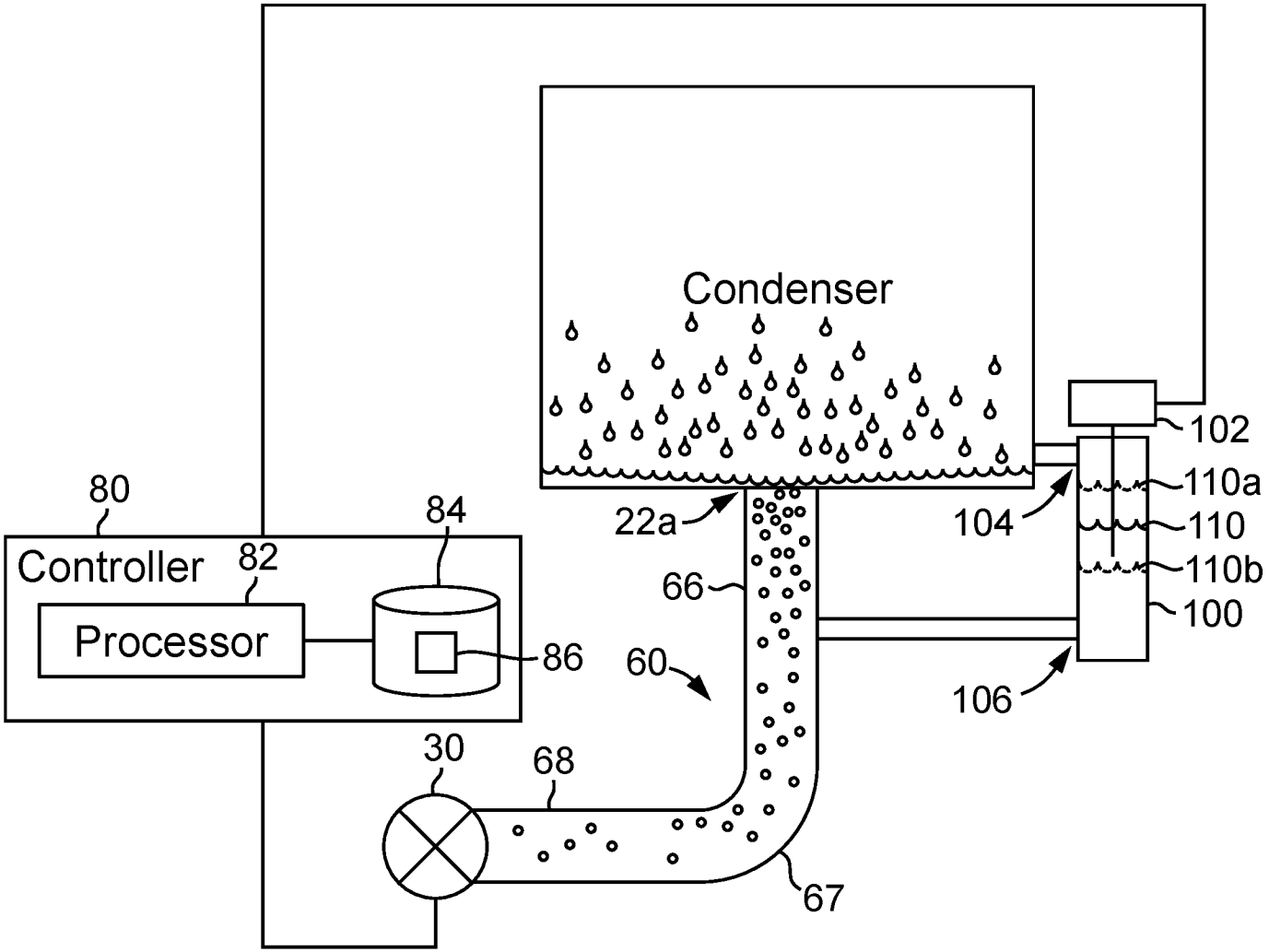
FIG. 7 is an enlarged, schematic view of a portion of the climate control system of FIG. 1 according to some embodiments disclosed herein.

Referring now to FIG. 7, in some embodiments, the vertical height of the first portion 66 of the first conduit 60 may be insufficient to allow for the desired vertical separation (e.g., length $L_{104-106}$ shown in FIG. 3) between the ports 104, 106 in the stand tube 100. As a result, the first port 104 may be connected directly to the condenser 22 so as to provide a sufficient separation of the ports 104, 106 (e.g., length $L_{104-106}$). The second port 106 may still be connected to the first portion 66 of the conduit 60. As a result, control operations for the first expansion valve 30 via the controller 80 may be substantially the same as previously described for the embodiment of stand tube 100 shown in FIG. 7. In addition, it should be appreciated that a similar arrangement may be employed for an embodiment of the stand tube 100 that is connected to the second conduit 62 between the economizer 28 and second expansion valve 32 (e.g., such as shown in FIG. 5), when a vertical height of a vertical portion of the second conduit 62 is insufficient for a desired separation of the ports 104, 106 of stand tube 100. Specifically, the first port 104 of the stand tube 100 may be connected directly to the economizer 28 while the second port 106 may be connected to a vertical portion of the second conduit 66 in at least some of these embodiments.

The embodiments disclosed herein include systems and methods for detecting an effective level or amount of liquid refrigerant in a conduit of a climate control system for use in controlling an actuatable component (e.g., an expansion valve). The liquid level (or value indicative thereof) may then be used to control the actuatable component to ensure sufficient flow of refrigerant throughout the circuit. Accordingly, through use of the embodiments disclosed herein, an actuatable component of a climate control system (e.g., such as a chiller) may be accurately controlled so as to ensure a balance of refrigerant in the refrigerant circuit and thereby efficient operation of climate control system during operations.

As explained above and reiterated below, the present disclosure includes, without limitation, the following example implementations.

Clause 1: A method of controlling a component of a climate control system, the method comprising: discharging a multiphase fluid from a condenser of the climate control system; flowing the multiphase fluid though a conduit that is downstream of the condenser, the multiphase fluid including a liquid portion and a gas portion; diverting a portion of the multiphase fluid out of the conduit and into a receptacle; determining a parameter of the multiphase fluid in the receptacle, the parameter corresponding to a composition of the liquid portion and the gas portion of the multiphase fluid; and controlling the component of the climate control system based at least in part on the parameter.

Clause 2: The method of any of the Clauses, wherein the receptacle is a stand tube coupled to the conduit, and wherein the parameter is a liquid level of the multiphase fluid in the stand tube.

Clause 3: The method of any of the Clauses, wherein the receptacle includes a capacitance sensor that is configured to measure the liquid level in the stand tube.

Clause 4: The method of any of the clauses, wherein the multiphase fluid includes a refrigerant, wherein the component comprises an expansion valve that is in fluid communication with the conduit, and wherein controlling the component comprises controlling a position of the expansion valve based at least in part on the liquid level.

Clause 5: The method of any of the Clauses, wherein the conduit includes at least a first portion connected to the condenser and a second portion connected to the expansion valve, wherein the first portion is oriented substantially vertically; and wherein diverting the portion of the multiphase fluid includes diverting the portion from the first portion of the conduit.

Clause 6: The method of any of the Clauses, wherein the stand tube extends substantially parallel to the first portion of the conduit.

Clause 7: The method of any of the Clauses, wherein stand tube includes a first port and a second port that are spaced from one another such that the first port is vertically lower than the second port; wherein diverting the portion of the multiphase fluid comprises diverting the portion into the first port; and wherein the method further comprises routing the portion of the multiphase fluid from the stand tube to the first portion of the conduit via the second port.

Clause 8: The method of any of the Clauses, wherein the first port and the second port are spaced from one another by a vertical distance that is in a range of about one to about four times an inner diameter of the first portion of the conduit.

Clause 9: The method of any of the clauses, wherein the stand tube has an inner diameter that is in a range of about 0.25 to about 2.5 times the inner diameter of the first portion of the conduit.

Clause 10: The method of any of the Clauses, wherein the component is an electronic expansion valve; and wherein controlling the component includes controlling an opening position of the electronic expansion valve to thereby control a flow of the multiphase fluid discharged from the condenser.

Clause 11: A climate control system comprising: a condenser that is configured to at least partially condense a refrigerant; an actuatable component that is configured to adjust a flow characteristic of the refrigerant; a conduit in fluid communication with an outlet of the condenser and positioned upstream of the actuatable component such that the conduit is configured to channel the refrigerant discharged out of the condenser toward the actuatable component; a receptacle in fluid communication with the conduit such that at least a portion of the refrigerant flowing through the conduit is diverted into the receptacle; a sensor configured to detect a parameter indicative of a liquid level of the refrigerant in the receptacle; and a controller communicatively coupled to the sensor and the actuatable component, wherein the controller is configured to actuate the actuatable component based at least in part on an output from the sensor.

Clause 12: The climate control system of any of the Clauses, wherein the actuatable component comprises an expansion valve, and wherein the controller is configured to open or close the expansion valve based at least in part on the output from the sensor.

Clause 13: The climate control system of any of the Clauses, wherein the receptacle comprises a substantially vertical stand tube that extends substantially parallel with at least a portion of the conduit.

Clause 14: The climate control system of any of the Clauses, wherein the sensor is configured to measure a mass of the refrigerant in the stand tube, and the controller is configured to convert the mass to the liquid level.

Clause 15: The climate control system of any of the Clauses, further comprising: a compressor that is configured to compress the refrigerant upstream of the condenser; an evaporator that is configured to at least partially vaporize the refrigerant upstream of the compressor; an economizer that is in fluid communication between the expansion valve and the evaporator, wherein the economizer is configured to divert at least some gaseous refrigerant to the compressor in bypass of the evaporator; and an expansion device in fluid communication between the economizer and the evaporator.

Clause 16: The climate control system of any of the Clauses, wherein the expansion device comprises a second actuatable expansion valve.

Clause 17: A chiller for conditioning an indoor space, the chiller comprising: an evaporator configured to at least partially vaporize a refrigerant; a compressor downstream of the evaporator that is configured to compress the refrigerant; a condenser downstream of the compressor that configured to at least partially condense the refrigerant; an economizer in fluid communication between the condenser and the evaporator that is configured to divert gaseous refrigerant to the compressor in bypass of the evaporator; a conduit that connects the condenser to the economizer; an expansion valve positioned along the conduit; a stand tube in fluid communication with the conduit and positioned upstream of the expansion valve; a sensor configured to detect a parameter indicative of a refrigerant liquid level in the stand tube; and a controller communicatively coupled to the sensor and the expansion valve, wherein the controller and configured to adjust a position of the expansion valve based at least in part on an output from the sensor.

Clause 18: The chiller of any of the Clauses, wherein the stand tube is oriented substantially vertically and is substantially parallel with at least a portion of the conduit.

Clause 19: The chiller of any of the Clauses, wherein the stand tube is in fluid communication with a pair of ports that are spaced from one another along the conduit.

Clause 20, The chiller of any of the Clauses, wherein the sensor includes a probe and is configured to detect a capacitance of the probe as a result of contact with liquid refrigerant in the stand tube.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of controlling a component of a climate control system, the method comprising:

discharging a multiphase fluid from a condenser of the climate control system;

flowing the multiphase fluid though a conduit that is downstream of the condenser, the multiphase fluid including a liquid portion and a gas portion;

diverting a portion of the multiphase fluid out of the conduit and into a receptacle, wherein the receptacle is a stand tube coupled to the conduit;

determining a parameter of the multiphase fluid in the receptacle, the parameter corresponding to a composition of the liquid portion and the gas portion of the multiphase fluid, and the parameter is a liquid level of the multiphase fluid in the stand tube; and controlling the component of the climate control system based at least in part on the parameter, wherein the component comprises an expansion valve that is in fluid communication with the conduit, and the controlling of the component comprises, controlling a position of the expansion valve based at least in part on the liquid level and the stand tube is coupled to the conduit in between the expansion valve and condenser.

2. The method of claim 1, wherein the receptacle includes a capacitance sensor that is configured to measure the liquid level in the stand tube.

3. The method of claim 1, wherein the conduit includes at least a first portion connected to the condenser and a second portion connected to the expansion valve, wherein the first portion is oriented substantially vertically; and wherein diverting the portion of the multiphase fluid includes diverting the portion from the first portion of the conduit.

4. The method of claim 3, wherein the stand tube extends substantially parallel to the first portion of the conduit.

5. The method of claim 4, wherein stand tube includes a first port and a second port that are spaced from one another such that the first port is vertically lower than the second port;

wherein diverting the portion of the multiphase fluid comprises diverting the portion into the first port; and wherein the method further comprises routing the portion of the multiphase fluid from the stand tube to the first portion of the conduit via the second port.

6. The method of claim 5, wherein the first port and the second port are spaced from one another by a vertical distance that is in a range of about one to about four times an inner diameter of the first portion of the conduit.

7. The method of claim 6, wherein the stand tube has an inner diameter that is in a range of about 0.25 to about 2.5 times the inner diameter of the first portion of the conduit.

8. The method of claim 1, wherein the component is an electronic expansion valve; and wherein controlling the component includes controlling an opening position of the electronic expansion valve to thereby control a flow of the multiphase fluid discharged from the condenser.

9. A climate control system comprising:

a condenser that is configured to at least partially condense a refrigerant;

an actuatable component that is configured to adjust a flow characteristic of the refrigerant;

a conduit in fluid communication with an outlet of the condenser and positioned upstream of the actuatable component such that the conduit is configured to channel the refrigerant discharged out of the condenser toward the actuatable component;

a receptacle in fluid communication with the conduit such that at least a portion of the refrigerant flowing through the conduit is diverted into the receptacle, wherein the receptacle is a stand tube coupled to the conduit;

a sensor configured to detect a parameter indicative of a liquid level of the refrigerant in the receptacle and the parameter is a liquid level of the multiphase fluid in the stand tube; and a controller communicatively coupled to the sensor and the actuatable component, wherein the actuatable component is an expansion valve that is in fluid communication with the conduit, the stand tube is coupled to the conduit in between the expansion valve and the condenser, and the controller is configured to control a position of the expansion valve based at least in part on the liquid level.

10. The climate control system of claim 9, wherein the receptacle comprises a substantially vertical stand tube that extends substantially parallel with at least a portion of the conduit.

11. The climate control system of claim 10, wherein the sensor is configured to measure a mass of the refrigerant in the stand tube, and the controller is configured to convert the mass to the liquid level.

12. The climate control system of claim 10, further comprising:

a compressor that is configured to compress the refrigerant upstream of the condenser;

an evaporator that is configured to at least partially vaporize the refrigerant upstream of the compressor;

an economizer that is in fluid communication between the expansion valve and the evaporator, wherein the economizer is configured to divert at least some gaseous refrigerant to the compressor in bypass of the evaporator; and an expansion device in fluid communication between the economizer and the evaporator.

13. The climate control system of claim 12, wherein the expansion device comprises a second actuatable expansion valve.

14. A chiller for conditioning an indoor space, the chiller comprising:

an evaporator configured to at least partially vaporize a refrigerant;

a compressor downstream of the evaporator that is configured to compress the refrigerant;

a condenser downstream of the compressor that configured to at least partially condense the refrigerant;

an economizer in fluid communication between the condenser and the evaporator that is configured to divert gaseous refrigerant to the compressor in bypass of the evaporator;

a conduit that connects the condenser to the economizer;

an expansion valve positioned along the conduit;

a stand tube in fluid communication with the conduit and positioned upstream of the expansion valve and downstream of the condenser;

a sensor configured to detect a parameter indicative of a refrigerant liquid level in the stand tube; and a controller communicatively coupled to the sensor and the expansion valve, wherein the controller and configured to adjust a position of the expansion valve based at least in part on the parameter that is indicative of the refrigerant liquid level in the stand tube.

15. The chiller of claim 14, wherein the stand tube is oriented substantially vertically and is substantially parallel with at least a portion of the conduit.

16. The chiller of claim 15, wherein the stand tube is in fluid communication with a pair of ports that are spaced from one another along the conduit.

17. The chiller of claim 14, wherein the sensor includes a probe and is configured to detect a capacitance of the probe as a result of contact with liquid refrigerant in the stand tube.

* * * * *